US007391172B2

(12) United States Patent
Ferguson et al.

(10) Patent No.: US 7,391,172 B2
(45) Date of Patent: Jun. 24, 2008

(54) OPTICAL AND TEMPERATURE FEEDBACKS TO CONTROL DISPLAY BRIGHTNESS

(75) Inventors: Bruce R. Ferguson, Anaheim, CA (US); George C. Henry, Simi Valley, CA (US); Roger Holliday, Santa Ana, CA (US)

(73) Assignee: Microsemi Corporation, Irvine, CA (US)

( * ) Notice: Subject to any disclaimer, the term of this patent is extended or adjusted under 35 U.S.C. 154(b) by 0 days.

(21) Appl. No.: 11/679,046

(22) Filed: Feb. 26, 2007

(65) Prior Publication Data

US 2007/0132398 A1 Jun. 14, 2007

Related U.S. Application Data

(63) Continuation of application No. 10/937,889, filed on Sep. 9, 2004, now Pat. No. 7,183,727.

(60) Provisional application No. 60/505,074, filed on Sep. 23, 2003.

(51) Int. Cl.
*H05B 37/02* (2006.01)
*G09G 3/36* (2006.01)

(52) U.S. Cl. ..... 315/308; 345/102

(58) Field of Classification Search ..... 315/149, 315/150, 156, 158, 291, 307, 308, 309; 345/102
See application file for complete search history.

(56) References Cited

U.S. PATENT DOCUMENTS

| | | | |
|---|---|---|---|
| 2,429,162 | A | 10/1947 | Russell et al. |
| 2,440,984 | A | 5/1948 | Summers |
| 2,572,258 | A | 10/1951 | Goldfield et al. |
| 2,965,799 | A | 12/1960 | Brooks et al. |
| 2,968,028 | A | 1/1961 | Eilichi et al. |
| 3,141,112 | A | 7/1964 | Eppert |
| 3,449,629 | A | 6/1969 | Wigert et al. |
| 3,565,806 | A | 2/1971 | Ross |
| 3,597,656 | A | 8/1971 | Douglas |
| 3,611,021 | A | 10/1971 | Wallace |
| 3,683,923 | A | 8/1972 | Anderson |
| 3,737,755 | A | 6/1973 | Calkin et al. |
| 3,742,330 | A | 6/1973 | Hodges et al. |

(Continued)

FOREIGN PATENT DOCUMENTS

EP 0326114 8/1989

(Continued)

OTHER PUBLICATIONS

Nguyen, Don J., "Optimizing Mobile Power Delivery". Presented at Intel Developers Forum, Fall 2001, p. 4.

(Continued)

*Primary Examiner*—Thuy Vinh Tran
(74) *Attorney, Agent, or Firm*—Knobbe, Martens, Olson & Bear LLP

(57) ABSTRACT

An illumination control circuit allows a user to set a desired brightness level and maintains the desired brightness level over temperature and life of a light source. The illumination control circuit uses a dual feedback loop with both optical and thermal feedbacks. The optical feedback loop controls power to the light source during normal operations. The thermal feedback loop overrides the optical feedback loop when the temperature of the light source becomes excessive.

20 Claims, 13 Drawing Sheets

U.S. PATENT DOCUMENTS 3,916,283 A 10/1975 Burrows
3,936,696 A 2/1976 Gray
3,944,888 A 3/1976 Clark
4,053,813 A 10/1977 Kornrumpf et al.
4,060,751 A 11/1977 Anderson
4,204,141 A 5/1980 Nuver
4,277,728 A 7/1981 Stevens
4,307,441 A 12/1981 Bello
4,353,009 A 10/1982 Knoll
4,388,562 A 6/1983 Josephson
4,392,087 A 7/1983 Zansky
4,437,042 A 3/1984 Morais et al.
4,441,054 A 4/1984 Bay
4,453,522 A 6/1984 Salzgeber
4,463,287 A 7/1984 Pitel
4,469,988 A 9/1984 Cronin
4,480,201 A 10/1984 Jaeschke
4,523,130 A 6/1985 Pitel
4,544,863 A 10/1985 Hashimoto
4,555,673 A 11/1985 Huijsing et al.
4,562,338 A 12/1985 Seiichi
4,567,379 A 1/1986 Corey et al.
4,572,992 A 2/1986 Masaki
4,574,222 A 3/1986 Anderson
4,585,974 A 4/1986 Stupp et al.
4,622,496 A 11/1986 Dattilo et al.
4,626,770 A 12/1986 Price, Jr.
4,630,005 A 12/1986 Clegg et al.
4,663,566 A 5/1987 Nagano
4,663,570 A 5/1987 Luchaco et al.
4,672,300 A 6/1987 Harper
4,675,574 A 6/1987 Delflache
4,682,080 A 7/1987 Ogawa et al.
4,686,615 A 8/1987 Ferguson
4,689,802 A 8/1987 McCambridge
4,698,554 A 10/1987 Stupp et al.
4,700,113 A 10/1987 Stupp et al.
4,717,863 A 1/1988 Zeiler
4,745,339 A 5/1988 Izawa et al.
4,761,722 A 8/1988 Pruitt
4,766,353 A 8/1988 Burgess
4,779,037 A 10/1988 LoCascio
4,780,696 A 10/1988 Jirka
4,792,747 A 12/1988 Schroeder
4,812,781 A 3/1989 Regnier
4,847,745 A 7/1989 Shekhawat
4,862,059 A 8/1989 Tominaga et al.
4,885,486 A 12/1989 Shekhawat et al.
4,893,069 A 1/1990 Harada et al.
4,902,942 A 2/1990 El-Hamamsy et al.
4,939,381 A 7/1990 Shibata
4,998,046 A 3/1991 Lester
5,023,519 A 6/1991 Jensen
5,030,887 A 7/1991 Guisinger
5,036,255 A 7/1991 McKnight et al.
5,049,790 A 9/1991 Herfurth et al.
5,057,808 A 10/1991 Dhyanchand
5,083,065 A 1/1992 Sakata et al.
5,089,748 A 2/1992 Ihms
5,105,127 A 4/1992 Lavaud et al.
5,130,565 A 7/1992 Girmay
5,130,635 A 7/1992 Kase
5,173,643 A 12/1992 Sullivan et al.
5,220,272 A 6/1993 Nelson
5,235,254 A 8/1993 Ho
5,289,051 A 2/1994 Zitta
5,317,401 A 5/1994 Dupont et al.
5,327,028 A 7/1994 Yum et al.
5,349,272 A 9/1994 Rector
5,406,305 A 4/1995 Shimoura et al. ..... 345/102
5,410,221 A 4/1995 Mattas et al.
5,420,779 A 5/1995 Payne
5,430,641 A 7/1995 Kates
5,434,477 A 7/1995 Crouse et al.
5,440,208 A 8/1995 Uskali et al.
5,463,287 A 10/1995 Kurihara et al.
5,471,130 A 11/1995 Agiman
5,475,284 A 12/1995 Lester et al.
5,475,285 A 12/1995 Konopka
5,479,337 A 12/1995 Voigt
5,485,057 A 1/1996 Smallwood et al.
5,485,059 A 1/1996 Yamashita et al.
5,485,487 A 1/1996 Orbach et al.
5,493,183 A 2/1996 Kimball
5,495,405 A 2/1996 Fujimura et al.
5,510,974 A 4/1996 Gu et al.
5,514,947 A 5/1996 Berg
5,519,289 A 5/1996 Katyl et al.
5,528,192 A 6/1996 Agiman
5,539,281 A 7/1996 Shackle et al.
5,548,189 A 8/1996 Williams
5,552,697 A 9/1996 Chan
5,557,249 A 9/1996 Reynal
5,563,473 A 10/1996 Mattas et al.
5,563,501 A 10/1996 Chan
5,574,335 A 11/1996 Sun
5,574,356 A 11/1996 Parker
5,608,312 A 3/1997 Wallace
5,612,594 A 3/1997 Maheshwari
5,612,595 A 3/1997 Maheshwari
5,615,093 A 3/1997 Nalbant
5,619,104 A 4/1997 Eunghwa
5,619,402 A 4/1997 Liu
5,621,281 A 4/1997 Kawabata et al.
5,629,588 A 5/1997 Oda et al.
5,635,799 A 6/1997 Hesterman
5,652,479 A 7/1997 LoCascio et al.
5,663,613 A 9/1997 Yamashita et al.
5,705,877 A 1/1998 Shimada
5,710,489 A 1/1998 Nilssen
5,712,533 A 1/1998 Corti
5,712,776 A 1/1998 Palara et al.
5,719,474 A 2/1998 Vitello
5,744,915 A 4/1998 Nilssen
5,748,460 A 5/1998 Ishihawa
5,751,115 A 5/1998 Jayaraman et al.
5,751,120 A 5/1998 Zeitler et al.
5,751,560 A 5/1998 Yokoyama
5,754,012 A 5/1998 LoCascio
5,754,013 A 5/1998 Praiswater
5,760,760 A 6/1998 Helms
5,770,925 A 6/1998 Konopka et al.
5,777,439 A 7/1998 Hua
5,786,801 A 7/1998 Ichise
5,796,213 A 8/1998 Kawasaki
5,808,422 A 9/1998 Venkitasubrahmanian et al.
5,818,172 A 10/1998 Lee
5,822,201 A 10/1998 Kijima
5,825,133 A 10/1998 Conway
5,828,156 A 10/1998 Roberts
5,844,540 A 12/1998 Terasaki
5,854,617 A 12/1998 Lee et al.
5,859,489 A 1/1999 Shimada
5,872,429 A 2/1999 Xia et al.
5,880,946 A 3/1999 Biegel
5,883,473 A 3/1999 Li et al.
5,886,477 A 3/1999 Honbo et al.
5,892,336 A 4/1999 Lin et al.
5,901,176 A 5/1999 Lewison
5,910,709 A 6/1999 Stevanovic et al.
5,910,713 A 6/1999 Nishi et al.
5,912,812 A 6/1999 Moriarty, Jr. et al.
5,914,842 A 6/1999 Sievers
5,923,129 A 7/1999 Henry 5,923,546 A 7/1999 Shimada et al.
5,925,988 A 7/1999 Grave et al.
5,930,121 A 7/1999 Henry
5,930,126 A 7/1999 Griffin et al.
5,936,360 A 8/1999 Kaneko
5,939,830 A 8/1999 Praiswater
6,002,210 A 12/1999 Nilssen
6,011,360 A 1/2000 Gradzki et al.
6,016,245 A 1/2000 Ross
6,020,688 A 2/2000 Moisin
6,028,400 A 2/2000 Pol et al.
6,037,720 A 3/2000 Wong et al.
6,038,149 A 3/2000 Hiraoka et al.
6,040,662 A 3/2000 Asayama
6,043,609 A 3/2000 George et al.
6,049,177 A 4/2000 Felper
6,069,448 A 5/2000 Yeh
6,072,282 A 6/2000 Adamson
6,091,209 A 7/2000 Hilgers
6,104,146 A 8/2000 Chou et al.
6,108,215 A 8/2000 Kates et al.
6,111,370 A 8/2000 Parra
6,114,814 A 9/2000 Shannon et al.
6,121,733 A 9/2000 Nilssen
6,127,785 A 10/2000 Williams
6,127,786 A 10/2000 Moisin
6,137,240 A 10/2000 Bogdan
6,150,772 A 11/2000 Crane
6,157,143 A 12/2000 Bigio et al.
6,160,362 A 12/2000 Shone et al.
6,169,375 B1 1/2001 Moisin
6,172,468 B1 1/2001 Hollander
6,181,066 B1 1/2001 Adamson
6,181,083 B1 1/2001 Moisin
6,181,084 B1 1/2001 Lau
6,188,183 B1 2/2001 Greenwood et al.
6,188,553 B1 2/2001 Moisin
6,194,841 B1 2/2001 Takahashi et al.
6,198,234 B1 3/2001 Henry
6,198,236 B1 3/2001 O'Neill
6,211,625 B1 4/2001 Nilssen
6,215,256 B1 4/2001 Ju
6,218,788 B1 4/2001 Chen et al.
6,229,271 B1 5/2001 Liu
6,239,558 B1 5/2001 Fujimura et al.
6,252,355 B1 6/2001 Meldrum et al.
6,255,784 B1 7/2001 Weindorf
6,259,215 B1 7/2001 Roman
6,259,615 B1 7/2001 Lin
6,281,636 B1 8/2001 Okutsu et al.
6,281,638 B1 8/2001 Moisin
6,291,946 B1 9/2001 Hinman
6,294,883 B1 * 9/2001 Weindorf ..... 315/291
6,307,765 B1 10/2001 Choi
6,310,444 B1 10/2001 Chang
6,313,586 B1 11/2001 Yamamoto et al.
6,316,881 B1 11/2001 Shannon et al.
6,316,887 B1 11/2001 Ribarich et al.
6,317,347 B1 11/2001 Weng
6,320,329 B1 11/2001 Wacyk
6,323,602 B1 11/2001 De Groot et al.
6,331,755 B1 12/2001 Ribarich et al.
6,340,870 B1 1/2002 Yamashita et al.
6,344,699 B1 2/2002 Rimmer
6,351,080 B1 2/2002 Birk et al.
6,356,035 B1 3/2002 Weng
6,359,393 B1 3/2002 Brown
6,362,577 B1 3/2002 Ito et al.
6,388,388 B1 5/2002 Weindorf et al.
6,396,217 B1 5/2002 Weindorf
6,396,722 B2 5/2002 Lin
6,417,631 B1 7/2002 Chen et al.
6,420,839 B1 7/2002 Chiang et al.
6,424,100 B1 7/2002 Kominami et al.
6,429,839 B1 8/2002 Sakamoto
6,433,492 B1 8/2002 Buonavita
6,441,943 B1 8/2002 Roberts et al.
6,445,141 B1 9/2002 Kastner et al.
6,452,344 B1 9/2002 MacAdam et al.
6,459,215 B1 10/2002 Nerone et al.
6,459,216 B1 10/2002 Tsai
6,469,922 B2 10/2002 Choi
6,472,827 B1 10/2002 Nilssen
6,472,876 B1 10/2002 Notohamiprodjo et al.
6,479,810 B1 11/2002 Weindorf
6,483,245 B1 11/2002 Weindorf
6,486,618 B1 11/2002 Li
6,494,587 B1 12/2002 Shaw et al.
6,495,972 B1 12/2002 Okamoto et al.
6,501,234 B2 12/2002 Lin et al.
6,507,286 B2 1/2003 Weindorf et al.
6,509,696 B2 1/2003 Bruning et al.
6,515,427 B2 2/2003 Oura et al.
6,515,881 B2 2/2003 Chou et al.
6,521,879 B1 2/2003 Rand et al.
6,522,558 B2 2/2003 Henry
6,531,831 B2 3/2003 Chou et al.
6,534,934 B1 3/2003 Lin et al.
6,559,606 B1 5/2003 Chou et al.
6,563,479 B2 5/2003 Weindorf et al.
6,570,344 B2 5/2003 Lin
6,570,347 B2 5/2003 Kastner
6,583,587 B2 6/2003 Ito et al.
6,593,703 B2 7/2003 Sun
6,628,093 B2 9/2003 Stevens
6,630,797 B2 10/2003 Qian et al.
6,633,138 B2 10/2003 Shannon et al.
6,642,674 B2 11/2003 Liao et al.
6,650,514 B2 11/2003 Schmitt
6,654,268 B2 11/2003 Choi
6,664,744 B2 12/2003 Dietz
6,680,834 B2 1/2004 Williams
6,703,998 B1 3/2004 Kabel et al.
6,707,264 B2 3/2004 Lin et al.
6,710,555 B1 3/2004 Terada et al.
6,864,867 B2 3/2004 Biebl
6,717,371 B2 4/2004 Klier et al.
6,717,372 B2 4/2004 Lin et al.
6,717,375 B2 4/2004 Noguchi et al.
6,724,602 B2 4/2004 Giannopoulos
6,765,354 B2 7/2004 Klein
6,781,325 B2 8/2004 Lee
6,784,627 B2 8/2004 Suzuki et al.
6,803,901 B1 10/2004 Numao
6,804,129 B2 10/2004 Lin
6,809,718 B2 10/2004 Wei et al.
6,809,938 B2 10/2004 Lin et al.
6,816,142 B2 11/2004 Oda et al.
6,856,099 B2 2/2005 Chen et al.
6,856,519 B2 2/2005 Lin et al.
6,870,330 B2 3/2005 Choi
6,876,157 B2 4/2005 Henry
6,897,698 B1 5/2005 Gheorghiu et al.
6,900,599 B2 5/2005 Ribarich
6,900,600 B2 5/2005 Rust et al.
6,900,993 B2 5/2005 Lin et al.
6,922,023 B2 7/2005 Hsu et al.
6,930,893 B2 8/2005 Vinciarelli
6,936,975 B2 8/2005 Lin et al.
6,947,024 B2 9/2005 Lee et al.
6,967,449 B2 11/2005 Ishihara
6,967,657 B2 11/2005 Lowles et al.
6,969,958 B2 11/2005 Henry
6,979,959 B2 12/2005 Henry
7,026,860 B1 4/2006 Gheorghiu et al.
7,057,611 B2 6/2006 Lin et al.

| | | | |
|---|---|---|---|
| 7,075,245 | B2 | 7/2006 | Liu |
| 7,095,392 | B2 | 8/2006 | Lin |
| 7,120,035 | B2 | 10/2006 | Lin et al. |
| 7,151,394 | B2 | 12/2006 | Gheorghiu et al. |
| 7,183,724 | B2 | 2/2007 | Ball |
| 7,187,140 | B2 | 3/2007 | Ball |
| 7,190,123 | B2 | 3/2007 | Lee |
| 7,202,458 | B2 | 4/2007 | Park |
| 7,233,117 | B2 | 6/2007 | Wang et al. |
| 7,236,020 | B1 | 6/2007 | Virgil |
| 2001/0036096 | A1 | 11/2001 | Lin |
| 2002/0030451 | A1 | 3/2002 | Moisin |
| 2002/0097004 | A1 | 7/2002 | Chiang et al. |
| 2002/0114114 | A1 | 8/2002 | Schmitt |
| 2002/0118182 | A1 | 8/2002 | Weindorf |
| 2002/0130786 | A1 | 9/2002 | Weindorf |
| 2002/0135319 | A1 | 9/2002 | Bruning et al. |
| 2002/0140538 | A1 | 10/2002 | Yer |
| 2002/0145886 | A1 | 10/2002 | Stevens |
| 2002/0153852 | A1 | 10/2002 | Liao et al. |
| 2002/0171376 | A1 | 11/2002 | Rust et al. |
| 2002/0180380 | A1 | 12/2002 | Lin |
| 2002/0180572 | A1 | 12/2002 | Kakehashi et al. |
| 2002/0181260 | A1 | 12/2002 | Chou et al. |
| 2002/0195971 | A1 | 12/2002 | Qian et al. |
| 2003/0001524 | A1 | 1/2003 | Lin et al. |
| 2003/0020677 | A1 | 1/2003 | Nakano |
| 2003/0025462 | A1 | 2/2003 | Weindorf |
| 2003/0080695 | A1 | 5/2003 | Ohsawa |
| 2003/0090913 | A1 | 5/2003 | Che-Chen et al. |
| 2003/0117084 | A1 | 6/2003 | Stack |
| 2003/0141829 | A1 | 7/2003 | Yu |
| 2003/0161164 | A1 | 8/2003 | Shannon et al. |
| 2003/0227435 | A1 | 12/2003 | Hsieh |
| 2004/0000879 | A1 | 1/2004 | Lee |
| 2004/0012556 | A1 | 1/2004 | Yong et al. |
| 2004/0017348 | A1 | 1/2004 | Numao |
| 2004/0032223 | A1 | 2/2004 | Henry |
| 2004/0051473 | A1 | 3/2004 | Jales et al. |
| 2004/0145558 | A1 | 7/2004 | Cheng |
| 2004/0155596 | A1 | 8/2004 | Ushijima |
| 2004/0155853 | A1 | 8/2004 | Lin |
| 2004/0189217 | A1 | 9/2004 | Ishihara et al. |
| 2004/0257003 | A1 | 12/2004 | Hsieh et al. |
| 2004/0263092 | A1 | 12/2004 | Liu |
| 2005/0062436 | A1 | 3/2005 | Jin |
| 2005/0093471 | A1 | 5/2005 | Jin |
| 2005/0093472 | A1 | 5/2005 | Jin |
| 2005/0093482 | A1 | 5/2005 | Ball |
| 2005/0093483 | A1 | 5/2005 | Ball |
| 2005/0093484 | A1 | 5/2005 | Ball |
| 2005/0094372 | A1 | 5/2005 | Jin |
| 2005/0099143 | A1 | 5/2005 | Kohno |
| 2005/0156536 | A1 | 7/2005 | Ball |
| 2005/0156539 | A1 | 7/2005 | Ball |
| 2005/0156540 | A1 | 7/2005 | Ball |
| 2005/0162098 | A1 | 7/2005 | Ball |
| 2005/0218825 | A1 | 10/2005 | Chiou |
| 2005/0225261 | A1 | 10/2005 | Jin |
| 2006/0022612 | A1 | 2/2006 | Henry |
| 2006/0049959 | A1 | 3/2006 | Sanchez |

FOREIGN PATENT DOCUMENTS

| | | |
|---|---|---|
| EP | 0587923 | 3/1994 |
| EP | 0597661 | 5/1994 |
| JP | 06168791 | 6/1994 |
| JP | 8-204488 | 8/1996 |
| KR | 10-2003-0075461 | 10/2003 |
| TW | 554643 | 9/2003 |
| WO | WO 94/15444 | 7/1994 |
| WO | WO 98/09369 | 3/1998 |

OTHER PUBLICATIONS

Tannas, Lawrence, "Flat Panel Displays and CRTs". © 1985 Van Nostrand Reinhold Company Inc., pp. 96-99.

Jordan et al., Resonant Fluorescent Lamp Converter Provides Efficient and Compact Solution, Mar. 1993, pp. 424-431.

Unitrode Datasheet, Resonant Fluorescent Lamp Driver, UC 1871/2871/3871, May 1993, pp. 1-6.

Unitrode Product & Applications Handbook 1993-94, U-141, Jun. 1993, pp. i-ii; 9-471-9-478.

Williams, Jim, Techniques for 92% Efficient LCD Illumination, Linear Technology Application Note 55, Aug. 1993.

Unitrode Datasheet, Resonant Fluorescent Lamp Driver, UC 1871/2871/3871, Oct. 1994, pp. 1-6.

O'Connor, J., Dimmable Cold-Cathode Fluorescent Lamp Ballast Design Using the UC3871, Application Note U-148, pp. 1-15, 1995.

Goodenough, Frank, DC-to-AC Inverter Ups CCFL Lumens Per Watt, Electronic Design, Jul. 10, 1995, pp. 143-148.

Coles, Single Stage CCFL Backlight Resonant Inverter using PWM Dimming Methods, 1998, pp. 35-38.

Micro Linear, ML4878 Single-Stage CCFL Backlight Resonant Inverter, Application Note 68, May 1998, pp. 1-12.

Williams, B.W.; "Power Electronics Devices, Drivers, Applications and Passive Components"; Second Edition, McGraw-Hill, 1992; Chapter 10, pp. 218-249.

Bradley, D.A., "Power Electronics" 2nd Edition, Chapman & Hall, 1995; Chapter 1, pp. 1-38.

Dubey, G. K., "Thyristorised Power Controllers"; Halsted Press, 1986; pp. 74-77.

IEEE Publication, "Dual Switched Mode Power Converter": Pallab Midya & Fred H. Schlereth; p. 155 1989.

IEEE Publication, "High Frequency Resonant Inverter For Group Dimming Control of Fluorescent Lamp Lighting Systems", K.H. Jee, et al., 1989 149-154.

Int. J. Electronics, "New soft-switching inverter for high efficiency electronic ballast with simple structure" E.C. Nho, et al., 1991, vol. 71, No. 3, 529-541.

Plaintiff O2 Micro International Limited's Preliminary Invalidity Contentions re Third-Party Defendant Microsemi Corporation Patents, dated Sep. 14, 2007.

Third-Party Defendant Microsemi Corporation's Brief in Support of its Claim Construction for U.S. Patent Nos. 5,930,121 and 6,198,234, dated Oct. 19, 2007.

Declaration of Irfan A. Lateef in Support of Third-Party Defendant Microsemi Corporation's Brief in Support of its Claim Construction for U.S. Patent Nos. 5,930,121 and 6,198,234, dated Oct. 19, 2007.

Plaintiff O2 Micro International Limited's Brief in Response to Third-Party Defendant Microsemi Corporation's Brief Re Claim Construction for U.S. Patent Nos. 5,930,121 and 6,198,234, dated Oct. 26, 2007.

Declaration of Henry C. Su in Support of Plaintiff 02 Micro International Limited's Brief in Response to Third-Party Defendant Microsemi Corporation's Brief Re Claim Construction for U.S. Patent Nos. 5,930,121 and 6,198,234, dated Oct. 26, 2007.

Defendant/Counterclaimant Monolithic Power Systems, Inc.'s Notice of Motion and Motion for Summary Judgement of Invalidity of Asserted Claims of U.S. Patent No. 6,198,234 dated Nov. 14, 2005.

Defendant/Counterclaimant Monolithic Power Systems, Inc.'s Memorandum of Points and Authorities in Support of Motion for Summary Judgment of Invalidity of Asserted Claims of U.S. Patent No. 6,198,234, dated Nov. 14, 2005.

Declaration of Robert Mammano filed by Defendant/Counterclaimant Monolithic Power Systems, Inc.'s In Support of its Motion for Summary Judgment of Invalidity of Asserted Claims of U.S. Patent No. 6,198,234, dated Nov. 14, 2005.

Declaration of John A. O'Connor filed by Defendant/Counterclaimant Monolithic Power Systems, Inc.'s In Support of Its Motion for Summary Judgment of Invalidity of Asserted Claims of U.S. Patent No. 6,198,234, dated Nov. 14, 2005.

Declaration of Defendant/Counterclaimant Monolithic Power Systems, Inc.'s Expert Witness, Dr. Douglas C. Hopkins, In Support of Its Motion for Summary Judgment of Invalidity of Asserted Claims of U.S. Patent No. 6,198,234, dated Nov. 14, 2005.
Declaration of Doyle Slack filed by Defendant/Counterclaimant Monolithic Power Systems, Inc.'s In Support of Its Motion for Summary Judgment of Invalidity of Asserted Claims of U.S. Patent No. 6,198,234, dated Nov. 14, 2005.
Declaration of Dean G. Dunlavey filed by Defendant/Counterclaimant Monolithic Power Systems, Inc.'s In Support of Its Motion for Summary Judgment of Invalidity of Asserted Claims of U.S. Patent No. 6,198,234, dated Nov. 14, 2005.
Declaration of Charles Coles filed by Defendant/Counterclaimant Monolithic Power Systems, Inc.'s In Support of Its Motion for Summary Judgment of Invalidity of Asserted Claims of U.S. Patent No. 6,198,234, dated Nov. 14, 2005.
Plaintiff Microsemi Corporation's Opposition to Defendant/Counterclaimant Monolithic Power Systems, Inc.'s Motion for Summary Judgment of Invalidity of Asserted Claims of U.S. Patent No. 6,198,234, dated Feb. 13, 2006.
Plaintiff Microsemi Corporation's Statement of Genuine Issues in Opposition to Defendant/Counterclaimant Monolithic Power Systems, Inc.'s Motion for Summary Judgment of Invalidity of Asserted Claims of U.S. Patent No. 6,198,234, dated Feb. 13, 2006.
Defendant/Counterclaimant Monolithic Power Systems, Inc.'s Reply Brief in Support of Motion for Summary Judgment of Invalidity of Asserted Claims of U.S. Patent No. 6,198,234, dated Mar. 13, 2006.
Supplemental Declaration of Dean G. Dunlavey filed by Defendant/Counterclaimant Monolithic Power Systems, Inc.'s In Support of Its Motion for Summary Judgment of Invalidity of Asserted Claims of U.S. Patent No. 6,198,234, dated Mar. 13, 2006.
Defendant/Counterclaimant Monolithic Power Systems, Inc.'s Notice of Motion and Motion for Summary Judgment of Invalidity of Asserted Claims of U.S. Patent No. 5,615,093, dated Nov. 14, 2005.
Defendant/Counterclaimant Monolithic Power Systems, Inc.'s Memorandum of Points and Authorities in Support of Motion for Summary Judgment of Invalidity of Asserted Claims of U.S. Patent No. 5,615,093, dated Nov. 14, 2005.
Plaintiff Microsemi Corporation's Opposition to Defendant/Counterclaimant Monolithic Power Systems, Inc.'s Motion for Summary Judgment of Invalidity of Asserted Claims of U.S. Patent No. 5,615,093, dated Feb. 13, 2006.
Plaintiff Microsemi Corporation's Statement of Genuine Issues in Opposition to Defendant/Counterclaimant Monolithic Power Systems, Inc.'s Motion for Summary Judgment of Invalidity of Asserted Claims of U.S. Patent No. 5,615,093, dated Feb. 13, 2006.
Defendant/Counterclaimant Monolithic Power Systems, Inc.'s Reply Brief in Support of Motion for Summary Judgment of Invalidity of Asserted Claims of U.S. Patent No. 5,615,093, dated Mar. 13, 2006.

* cited by examiner

OPTICAL AND TEMPERATURE FEEDBACKS TO CONTROL DISPLAY BRIGHTNESS

CLAIM FOR PRIORITY

This is a continuation application based on U.S. application Ser. No. 10/937,889, filed Sep. 9, 2004, now U.S. Pat. No. 7,183,727, which claims the benefit of priority under 35 U.S.C. § 119(e) of U.S. Provisional Application No. 60/505,074 entitled "Thermal and Optical Feedback Circuit Techniques for Illumination Control," filed on Sep. 23, 2003, the entirety of which is incorporated herein by reference.

BACKGROUND OF THE INVENTION

1. Field of the Invention

The present invention relates to a backlight system, and more particularly relates to using optical and temperature feedbacks to control the brightness of the backlight.

2. Description of the Related Art

Backlight is used in liquid crystal display (LCD) applications to illuminate a screen to make a visible display. The applications include integrated displays and projection type systems, such as a LCD television, a desktop monitor, etc. The backlight can be provided by a light source, such as, for example, a cold cathode fluorescent lamp (CCFL), a hot cathode fluorescent lamp (HCFL), a Zenon lamp, a metal halide lamp, a light emitting diode (LED), and the like. The performance of the light source (e.g., the light output) is sensitive to ambient and lamp temperatures. Furthermore, the characteristics of the light source change with age.

SUMMARY OF THE INVENTION

One embodiment of the present invention is an illumination control circuit which allows a user to set a desired brightness level and maintains the desired brightness level over temperature and life of a light source (e.g., a fluorescent lamp). The illumination control circuit uses an optical sensor (e.g., a visible light sensor) to maintain consistent brightness over lamp life and over extreme temperature conditions. The illumination control circuit further includes a temperature sensor to monitor lamp temperature and prolongs lamp life by reducing power to the fluorescent lamp when the lamp temperature is excessive. In one embodiment, the illumination control circuit optionally monitors ambient light and automatically adjusts lamp power in response to variations for optimal power efficiency.

The brightness (or the light intensity) of the light source (e.g., CCFL) is controlled by controlling a current (i.e., a lamp current) through the CCFL. For example, the brightness of the CCFL is related to an average current provided to the CCFL. Thus, the brightness of the CCFL can be controlled by changing the amplitude of the lamp current (e.g., amplitude modulation) or by changing the duty cycle of the lamp current (e.g., pulse width modulation).

A power conversion circuit (e.g., an inverter) is generally used for driving the CCFL. In one embodiment, the power conversion circuit includes two control loops (e.g., an optical feedback loop and a thermal feedback loop) to control the lamp current. A first control loop senses the visible light produced by the CCFL, compares the detected visible light to a user defined brightness setting, and generates a first brightness control signal during normal lamp operations. A second feedback loop senses the temperature of the CCFL, compares the detected lamp temperature to a predefined temperature limit, and generates a second brightness control signal that overrides the first brightness control signal to reduce the lamp current when the detected lamp temperature is greater than the predefined temperature limit. In one embodiment, both of the control loops use error amplifiers to perform the comparisons between detected levels and respective predetermined levels. The outputs of the error amplifiers are wired-OR to generate a final brightness control signal for the power conversion circuit.

In one embodiment, an illumination control circuit includes an optical or a thermal feedback sensor integrated with control circuitry to provide adjustment capabilities to compensate for temperature variations, to disguise aging, and to improve the response speed of the light source. For example, LCD computer monitors make extensive use of sleep functions for power management. The LCD computer monitors exhibit particular thermal characteristics depending on the sleep mode patterns. The thermal characteristics affect the "turn on" brightness levels of the display. In one embodiment, the illumination control circuit operates in a boost mode to expedite the display to return to a nominal brightness after sleep mode or an extended off period.

In one embodiment, a light sensor (e.g., an LX1970 light sensor from Microsemi Corporation) is coupled to a monitor to sense the perceived brightness of a CCFL used in the backlight or display. For example, the light sensor can be placed in a hole in the back of the display. The light sensor advantageously has immunity to infrared light and can accurately measure perceived brightness when the CCFL is in a warming mode. The output frequency of the CCFL shifts from infrared to the visible light spectrum as the temperature increases during the warming mode.

In one embodiment, the output of the light sensor is used by a boost function controller to temporary increase lamp current to the CCFL to reach a desired brightness level more quickly than using standard nominal lamp current levels. The light sensor monitors the CCFL light output and provides a closed loop feedback method to determine when a boost in the lamp current is desired. In an alternate embodiment, a thermistor is used to monitor the temperature of the CCFL lamp and to determine when boosted lamp current is desired.

In one embodiment, an inverter is used to drive the CCFL. The inverter includes different electrical components, and one of the components with a temperature profile closely matching the temperature profile of the CCFL is used to track the warming and cooling of a LCD display. The component can be used as a reference point for boost control functions when direct access to lamp temperature is difficult.

Providing a boost current to the CCFL during initial activation or reactivation from sleep mode of the display improves the response time of the display. For example, the display brightness may be in the range of 40%-50% of the nominal range immediately after turn on. Using a normal start up current (e.g., 8 mA) at 23 degrees C., the 90% brightness level may be achieved in 26 minutes. Using a 50% boost current (e.g., 12 mA), the 90% brightness level may be achieved in 19 seconds. The boost level can be adjusted as desired to vary the warm-up time of the display. The warm-up time is a function of the display or monitor settling temperature. For example, shorter sleep mode periods mean less warm-up times to reach the 90% brightness level.

In one embodiment, the boost control function can be implemented with low cost and low component count external circuitry. The boost control function enhances the performance of the display monitor for a computer user. For example, the display monitor is improved by reducing the time to reach 90% brightness by 50 to 100 times. The boost control function benefits office or home computing environments where sleep mode status is frequent. Furthermore, as the size of LCD display panels increase in large screen displays, the lamp length and chassis also increase. The larger lamp and chassis leads to system thermal inertia, which slows the warm-up time. The boost control function can be used to speed up the warm-up time.

In one embodiment, a light sensor monitors an output of a CCFL. A boost control circuit compares an output of the light sensor to a desired level. When the output of the light sensor is less than the desired level, the CCFL is operated at a boost mode (e.g., at an increased or boosted lamp current level). As the output of the light sensor reaches the desired level, indicating that the brightness is approaching a desired level, the boosted lamp current is reduced to a preset nominal current level.

In one embodiment, the boost control circuit is part of the optical feedback loop and facilitates a display that is capable of compensating for light output degradation over time. For example, as the lamp output degrades over usage hours, the lamp current level can be increased to provide a consistent light output. LCD televisions and automotive GPS/Telematic displays can offer substantially the same brightness provided on the day of purchase after two years of use.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage of group of advantages as taught herein without necessarily achieving other advantages as may be taught or suggested herein.

DETAILED DESCRIPTION OF THE INVENTION

Figure 1:
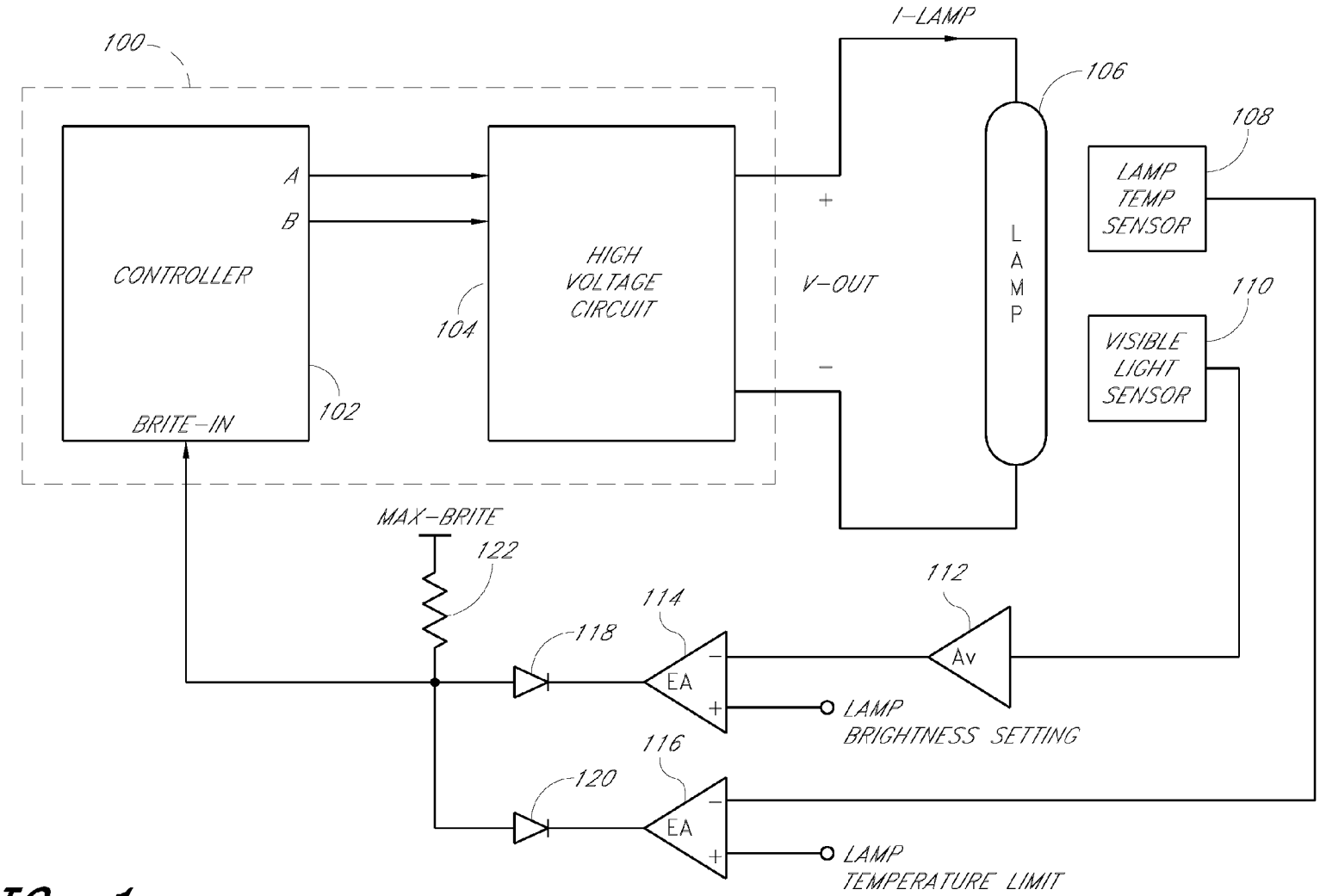
FIG. 1 is a block diagram of a power conversion circuit with dual feedback loops in accordance with one embodiment of the invention.

Various embodiments of the present invention will be described hereinafter with reference to the drawings. FIG. 1 is a block diagram of a power conversion circuit (or backlight system) with dual feedback loops in accordance with one embodiment of the invention. The backlight system may be advantageously used in automotive applications which are exposed to relatively extreme temperature variations and suffer brightness loss at low ambient temperatures. The backlight system can also be used in other LCD applications, such as computer notebooks, computer monitors, handheld devices, television displays, and the like. The dual feedback loops allow a user to set a desired brightness level for a backlight light source and maintain the desired brightness level over operating temperature and over degradation of the light source efficacy over life. The dual feedback loops also extend the useful life of the light source by maintaining safe operating conditions for the light source.

The power conversion circuit of FIG. 1 generates a substantially alternating current (AC) output voltage (V-OUT) to drive a fluorescent lamp (e.g., a CCFL) 106. In one embodiment, an inverter 100 generates the substantially AC output voltage from a direct current (DC) input voltage. The inverter 100 includes a controller 102 which accepts a brightness control input signal (BRITE-IN) and generates switching signals (A, B) to a high voltage circuit 104 to generate the substantially AC output voltage. A corresponding AC lamp current (I-LAMP) flows through the CCFL 106 to provide illumination.

Figure 2:
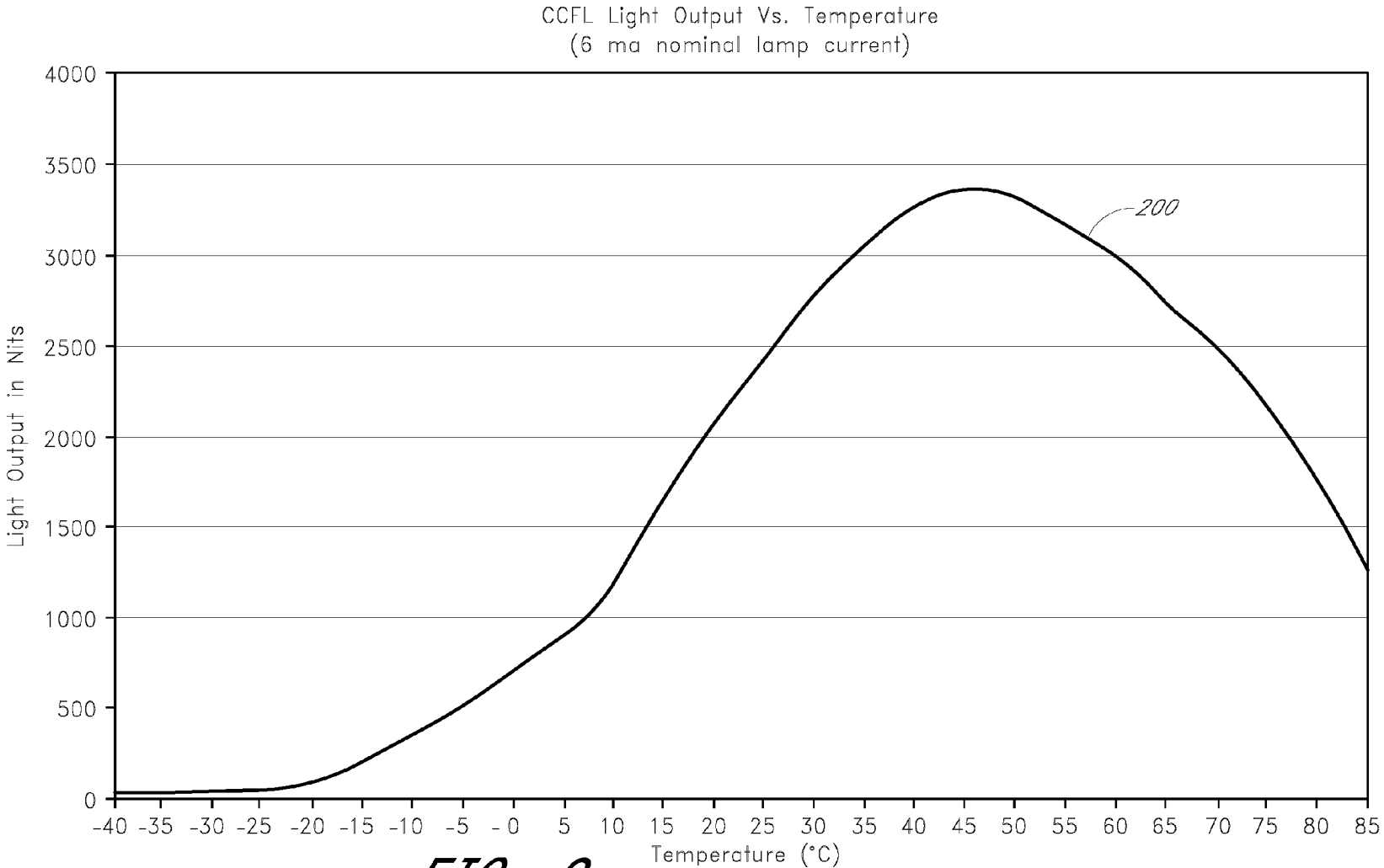
FIG. 2 illustrates light output of a CCFL with respect to temperature.

In one embodiment, the dual feedback loops control the brightness of the CCFL 106 and include an optical feedback loop and a lamp temperature feedback loop. The dual feedback loops generate the brightness control input signal to the controller 102. The brightness of the CCFL 106 is a function of the root mean square (RMS) level of the lamp current, ambient temperature of the CCFL 106, and life of the CCFL 106. For example, FIG. 2 illustrates light output of a CCFL with respect to temperature. The lamp brightness is affected by ambient and lamp temperatures. A graph 200 shows the relationship for a standard pressure CCFL at a nominal operating lamp current of 6 mA.

Lamp brightness decreases as the CCFL 106 ages (or when the lamp temperature decreases) even though the RMS level of the lamp current remains the same. The dual feedback loops facilitate consistent lamp brightness over lamp life and varying lamp temperature by compensating with adjusted RMS levels of the lamp current. The dual feedback loops further facilitate prolonged lamp life by monitoring the temperature of the CCFL 106.

As shown in FIG. 1, the optical feedback loop includes a visible light sensor 110, an optional gain amplifier 112, and a first error amplifier 114. The visible light sensor 110 monitors the actual (or perceived) brightness of the CCFL 106 and outputs an optical feedback signal indicative of the lamp brightness level. The optional gain amplifier 112 conditions (e.g., amplifies) the optical feedback signal and presents a modified optical feedback signal to the first error amplifier 114. In one embodiment, the modified optical feedback signal is provided to an inverting input of the first error amplifier 114. A first reference signal (LAMP BRIGHTNESS SETTING) indicative of a desired lamp intensity is provided to a non-inverting input of the first error amplifier 114. The first reference signal can be defined (varied or selected) by a user.

The first error amplifier 114 outputs a first brightness control signal used to adjust the lamp drive current to achieve the desired lamp intensity. For example, the lamp current is regulated by the optical feedback loop such that the modified optical feedback signal at the inverting input of the first error amplifier 114 is substantially equal to the first reference signal. The optical feedback loop compensates for aging of the CCFL 106 and lamp temperature variations during normal operations (e.g., when the lamp temperature is relatively cool). For example, the optical feedback loop may increase the lamp drive current as the CCFL 106 ages or when the lamp temperature drops.

There is a possibility that an aged lamp in hot ambient temperature may be driven too hard and damaged due to excessive heat. The lamp temperature feedback loop monitors the lamp temperature and overrides the optical feedback loop when the lamp temperature exceeds a predetermined temperature threshold. In one embodiment, the lamp temperature feedback loop includes a lamp temperature sensor 108 and a second error amplifier 116. The lamp temperature sensor 108 can detect the temperature of the CCFL 106 directly or derive the lamp temperature by measuring ambient temperature, temperature of a LCD bezel, amount of infrared light produced by the CCFL 106, or variations in the operating voltage (or lamp voltage) across the CCFL 106. In one embodiment, select components (e.g., switching transistors or transformers) in the inverter 100 can be monitored to track lamp temperature.

The lamp temperature sensor 108 outputs a temperature feedback signal indicative of the lamp temperature to an inverting input of the second error amplifier 116. A second reference signal (LAMP TEMPERATURE LIMIT) indicative of the predetermined temperature threshold is provided to a non-inverting input of the second error amplifier 116. The second error amplifier 116 outputs a second brightness control signal that overrides the first brightness control signal to reduce the lamp drive current when the lamp temperature exceeds the predetermined temperature threshold. Reducing the lamp drive current helps reduce the lamp temperature, thereby extending the life of the CCFL 106.

In one embodiment, the output of the first error amplifier 114 and the output of the second error amplifier 116 are wire-ORed (or coupled to ORing diodes) to generate the brightness control input signal to the controller 102. For example, a first diode 118 is coupled between the output of the first error amplifier 114 and the controller 102. A second diode 120 is coupled between the output of the second error amplifier 116 and the controller 102. The first diode 118 and the second diode 120 have commonly connected anodes coupled to the brightness control input of the controller 102. The cathode of the first diode 118 is coupled to the output of the first error amplifier 114, and the cathode of the second diode 120 is coupled to the output of the second error amplifier 116. Other configurations or components are possible to implement an equivalent ORing circuit to accomplish the same function.

In the above configuration, the error amplifier with a relatively lower output voltage dominates and determines whether the optical feedback loop or the lamp temperature feedback loop becomes the controlling loop. For example, the second error amplifier 116 have a substantially higher output voltage during normal operations when the lamp temperature is less than the predetermined temperature threshold and is effectively isolated from the brightness control input by the second diode 120. The optical feedback loop controls the brightness control input during normal operations and automatically adjusts the lamp drive current to compensate for aging and temperature variations of the CCFL 106. Control of the brightness control input transfers to the lamp temperature feedback loop when the temperature of the CCFL 106 becomes too high. The temperature of the CCFL 106 may be excessive due to relatively high external ambient temperature, relatively high lamp drive current, or a combination of both. The lamp temperature feedback loop reduces (or limits) the lamp drive current to maintain the lamp temperature at or below a predetermined threshold. In one embodiment, the first and second error amplifiers 114, 116 have integrating functions to provide stability to the respective feedback loops.

In one embodiment, the brightness control input signal is a substantially DC control voltage that sets the lamp current. For example, the RMS level of the lamp current may vary with the level of the control voltage. A pull-up resistor 122 is coupled between the brightness control input of the controller 102 and a pull-up control voltage (MAX-BRITE) corresponding to a maximum allowable lamp current. The pull-up control voltage dominates when both of the outputs of the respective error amplifiers 114, 116 are relatively high. The output of the first error amplifier 114 may be relatively high during warm-up or when the CCFL 106 becomes too old to produce the desired light intensity. The output of the second error amplifier 116 may be relatively high when the temperature of the CCFL 106 is relatively cold.

Figure 3:
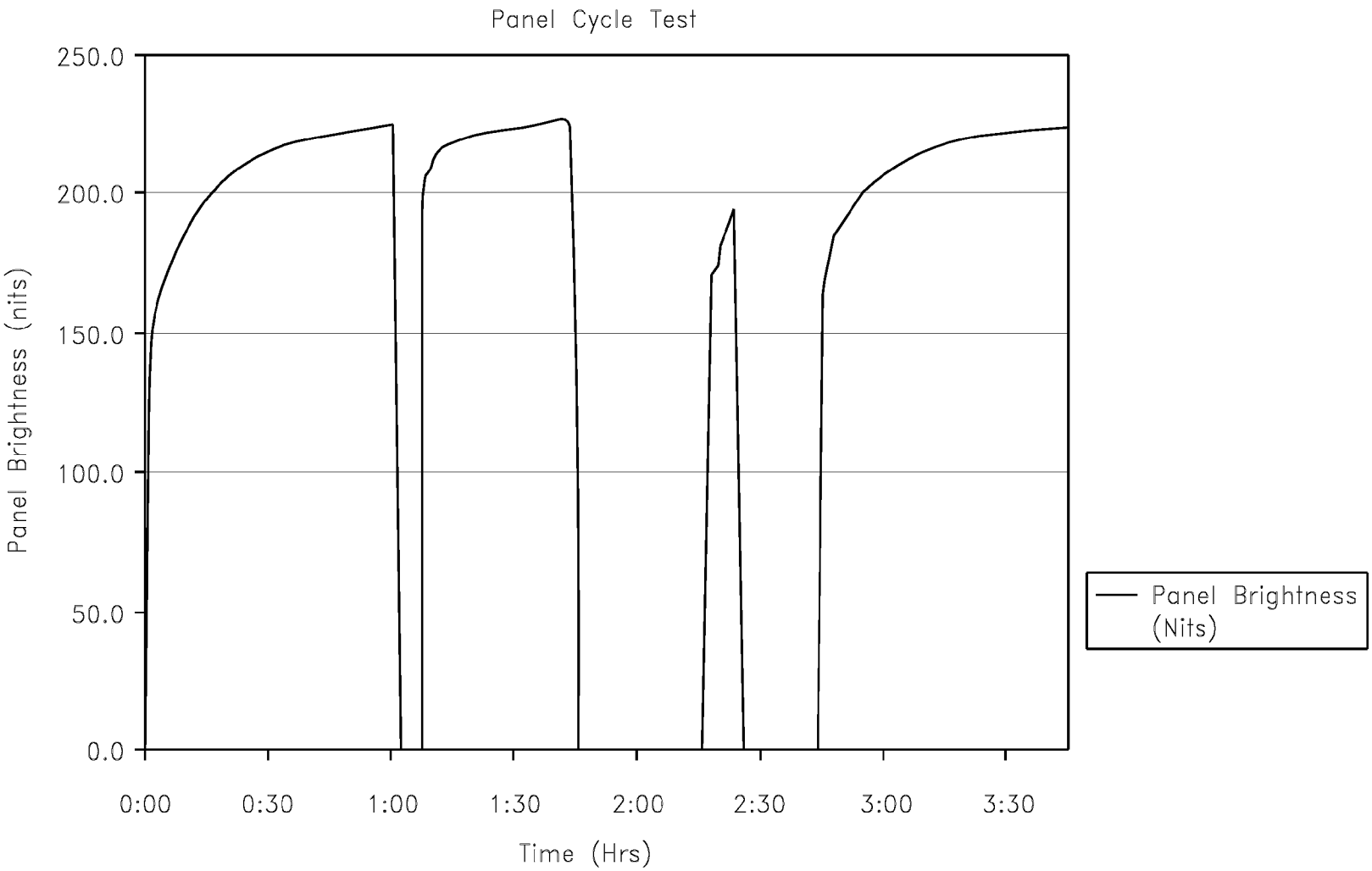
FIG. 3 illustrates panel brightness with respect to time as a display panel cycles on and off.

FIG. 3 illustrates panel brightness with respect to time as a display panel cycles on and off or exits from sleep mode. Computer applications make extensive use of sleep functions for power management. A graph 300 shows different warm-up times depending on how much time elapsed since the display panel was turned off or entered the sleep mode and allowed to cool down. For example, initial panel brightness may be only 60-70% of steady-state panel brightness during warm-up after the display panel turns on or exits from sleep mode. The warm-up time takes longer when the display panel has been inactive for a while, in cooler ambient temperatures, or for larger display panels.

In one embodiment, an optical feedback loop or a temperature feedback loop is used to decrease the warm-up time. For example, a controller controlling illumination of the display panel can operate in overdrive or a boost mode to improve response of the display brightness. The boost mode provides a higher lamp drive current than normal operating lamp current to speed up the time to reach sufficient panel brightness (e.g., 90% of steady-state). In one embodiment, the brightness control input signal described above can be used to indicate to the controller when boost mode operation is desired.

Figure 4:
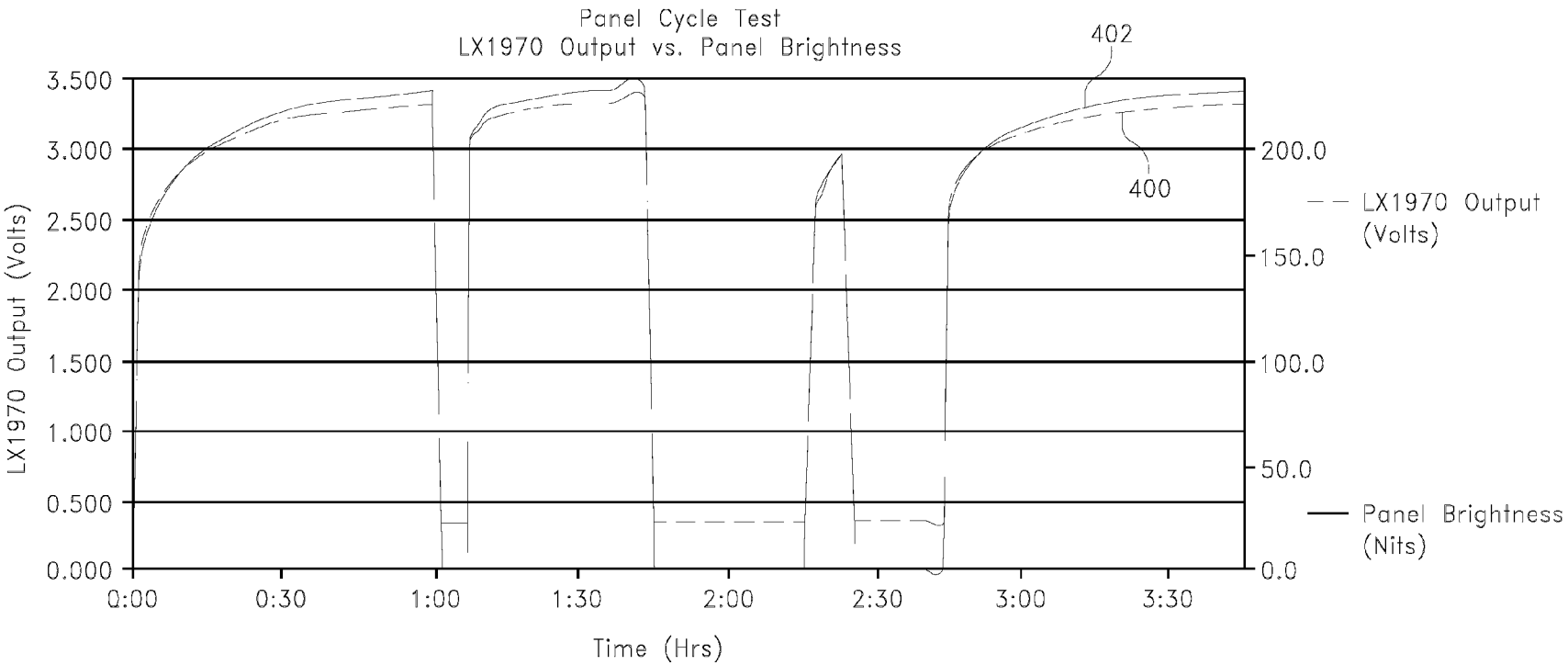
FIG. 4 illustrates waveforms for panel brightness and a light sensor output with respect to time as a display panel cycles on and off.

FIG. 4 illustrates waveforms for panel brightness and a light sensor output with respect to time as a display panel cycles on and off. A graph 402 shows the panel brightness. A graph 400 shows the light sensor output which closely tracks the panel brightness. In one embodiment, the light sensor output is produced by a visible light sensor (e.g., part number LX1970 from Microsemi Corporation).

Figure 5:
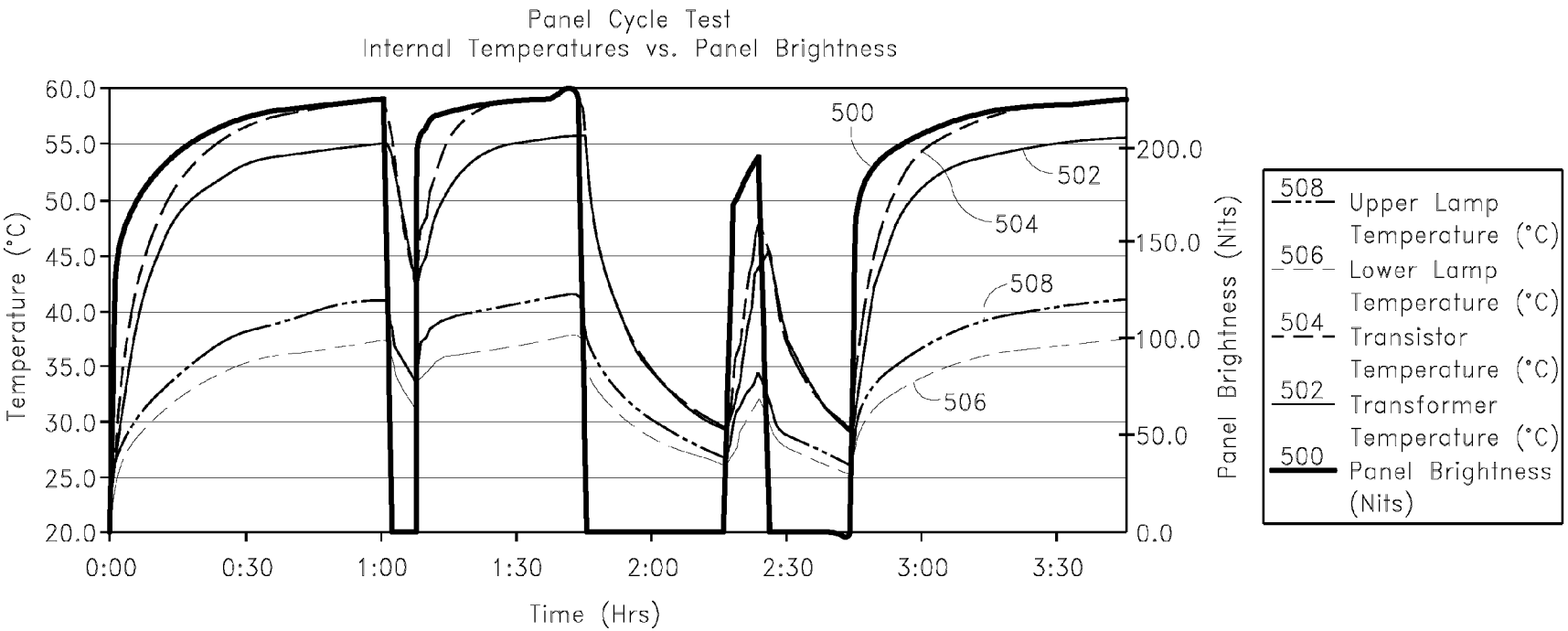
FIG. 5 illustrates waveforms for panel brightness and temperatures of select inverter components with respect to time as a display panel cycles on and off.

FIG. 5 illustrates waveforms for panel brightness and temperatures of select inverter components with respect to time as a display panel cycles on and off. A graph 500 shows the panel brightness. A graph 502 shows the temperature profile of a transformer and a graph 504 shows the temperature profile of a transistor as the panel brightness changes. A graph 506 shows the temperature profile of a lower lamp and a graph 508 shows the temperature profile of an upper lamp as the panel brightness changes. As discussed above, a select component (e.g., the transistor or the transformer) can be used in an indirect method to monitor lamp temperature.

Figure 6:
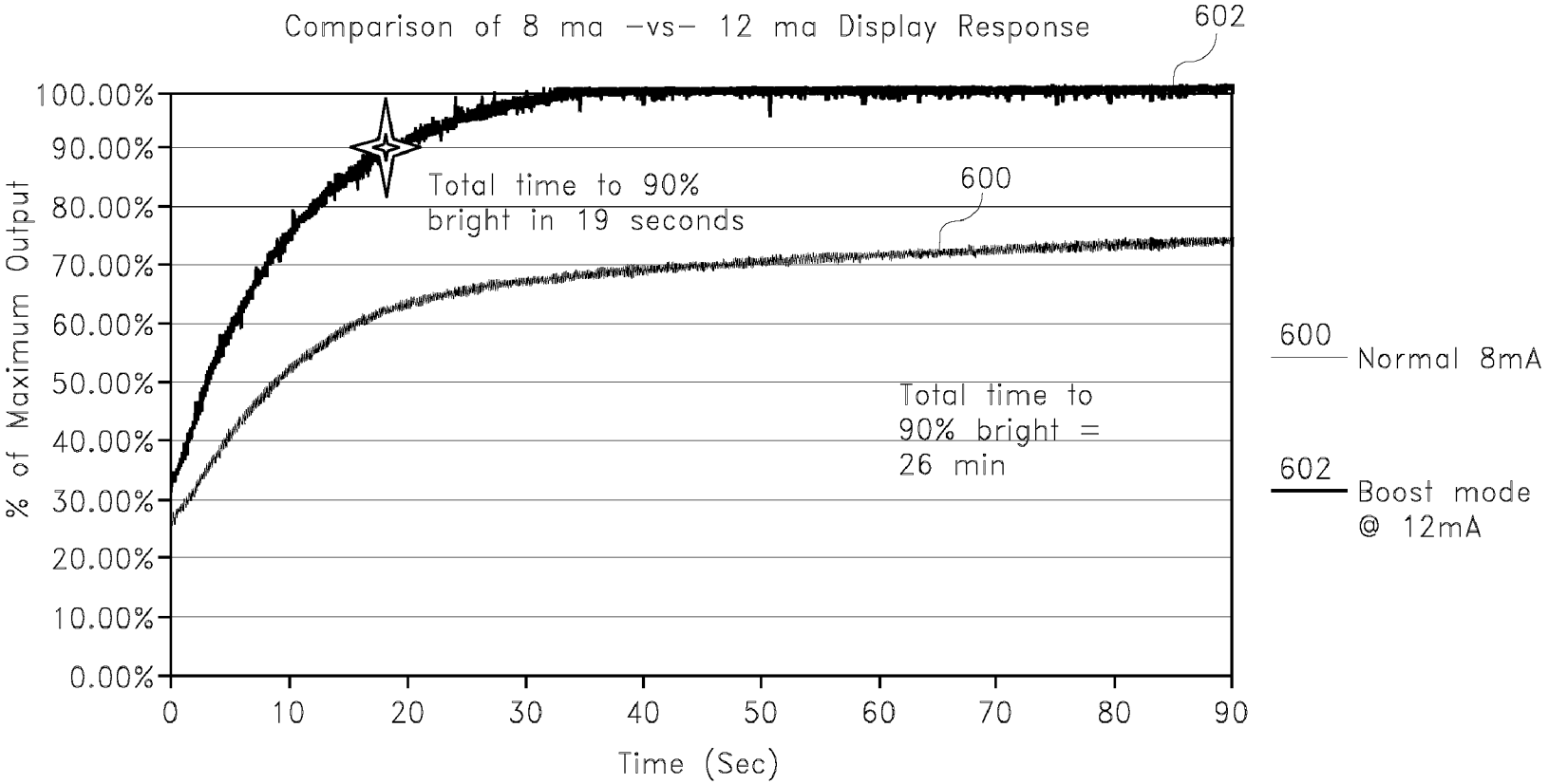
FIG. 6 illustrates waveforms comparing warm-up times using a standard drive current and a boost current.

FIG. 6 illustrates waveforms comparing warm-up times using a standard drive current and a boost current. A graph 600 shows a relatively slow response time for a lamp when a nominal current (e.g., 8 mA) is used to drive the lamp. A graph 602 shows an improved response time for the lamp when a boosted current (e.g., 12 mA) is used to drive the lamp during warm-up.

Figure 7:
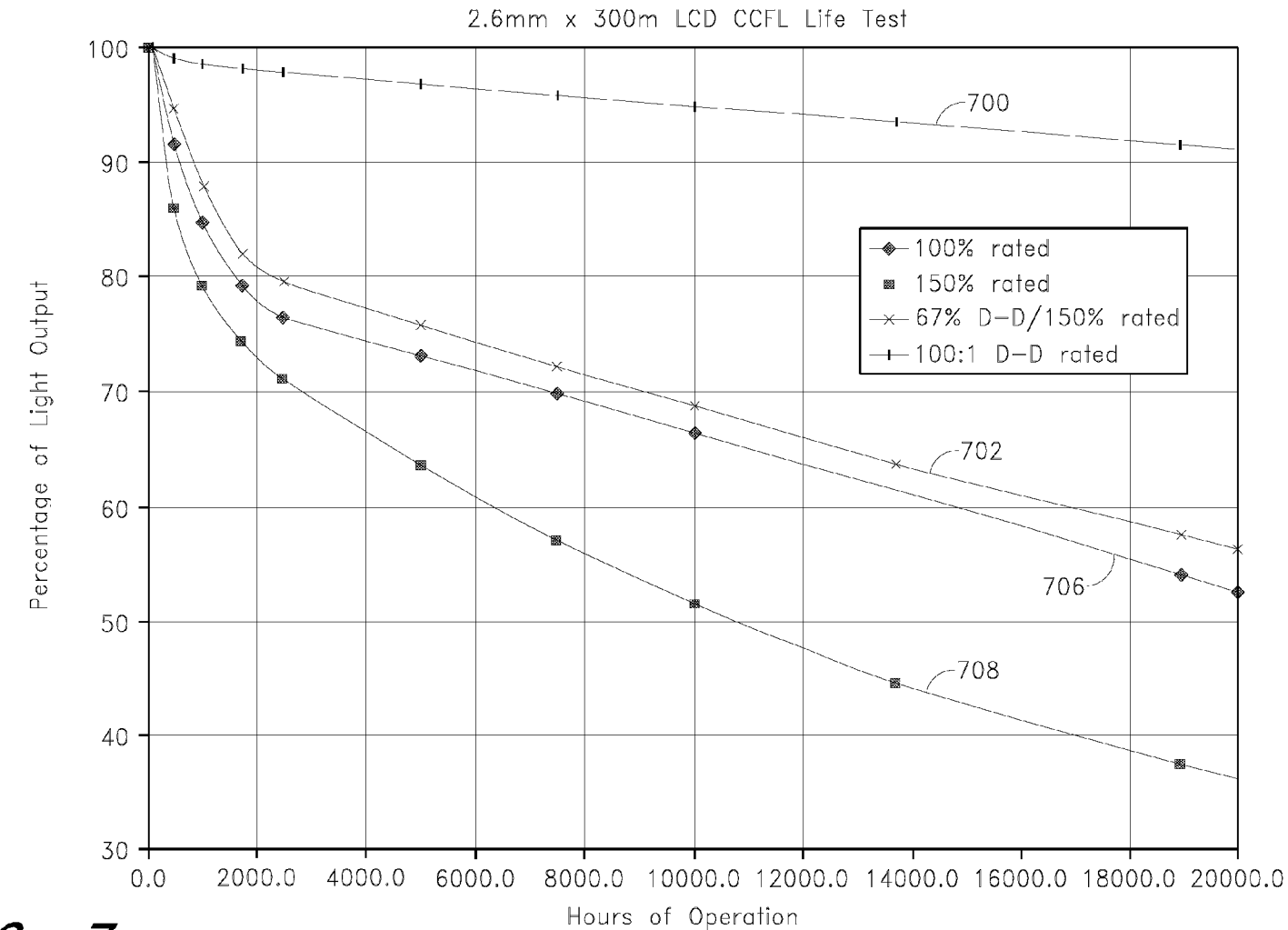
FIG. 7 illustrates waveforms comparing percentage of light output with respect to hours of operation for various operating conditions.

FIG. 7 illustrates waveforms comparing percentage of light output with respect to hours of operation for various operating conditions. A graph 700 shows the light output during life test of a lamp driven by a direct drive inverter running at 1% duty cycle. A graph 702 shows the light output during life test of a lamp driven by the direct drive inverter running at 150% of the rated lamp current or a typical inverter running at 67% of the rated lamp current. A graph 706 shows the light output during life test of a lamp driven by a typical inverter running at 100% of the rated lamp current. Finally, a graph 708 shows the light output during life test of a lamp driven by a typical inverter running at 150% of the rated lamp current. CCFLs degrade at a predictable rate over time. Lamp life specifications are defined as the point at which the display brightness level reduces to 50% of the original level.

Figure 8:
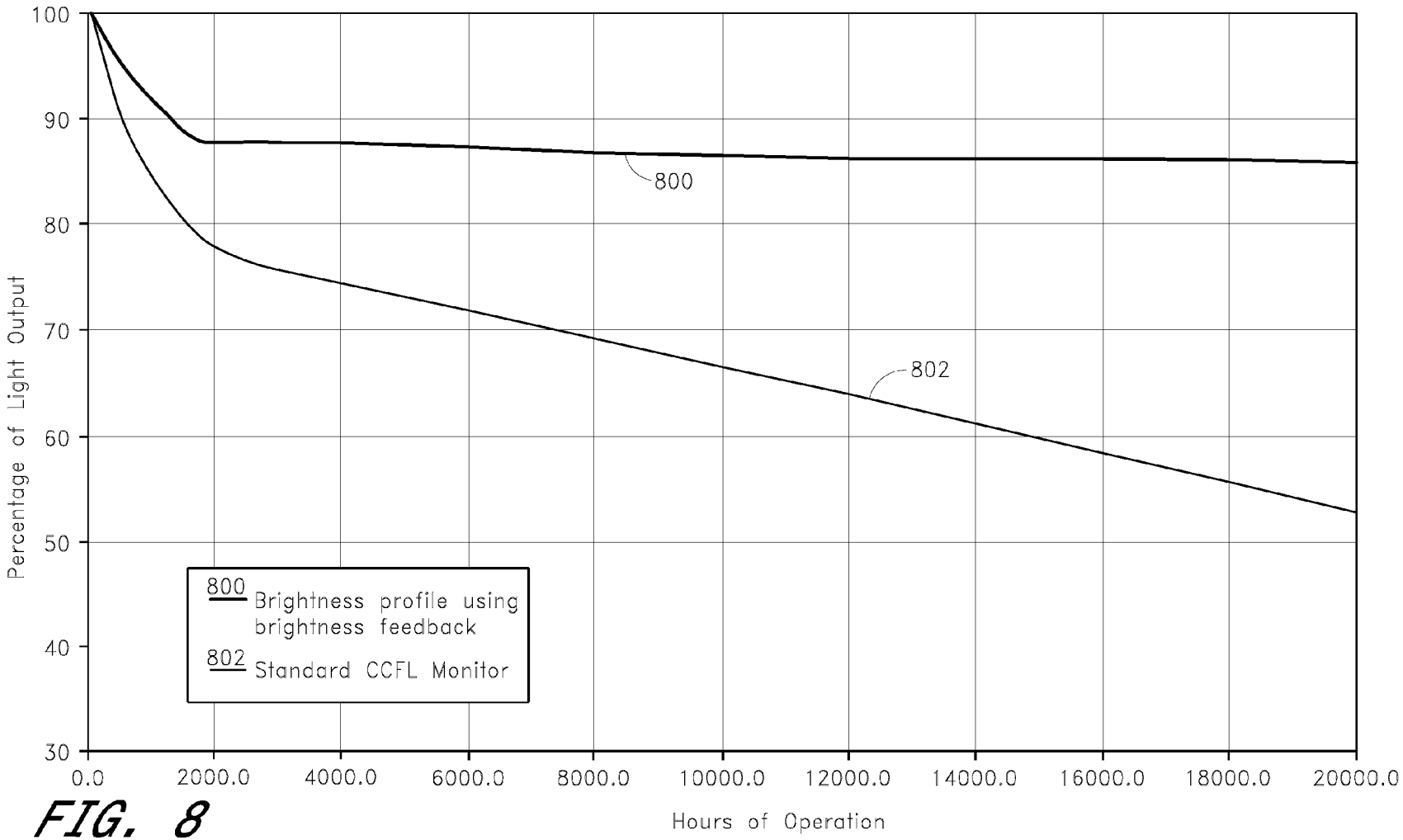
FIG. 8 illustrates waveforms comparing light outputs with and without optical feedback over the life of a CCFL.

FIG. 8 illustrates waveforms comparing light outputs with and without optical feedback over the life of a CCFL. A graph 802 shows the degradation of the light output as the CCFL ages. A graph 800 shows more consistent brightness over the life of the CCFL by using the optical feedback loop described above. Monitoring the perceived brightness of the CCFL provides a low cost and high performance method to maintain "out of the box" brightness levels as the CCFL ages.

Figure 9:
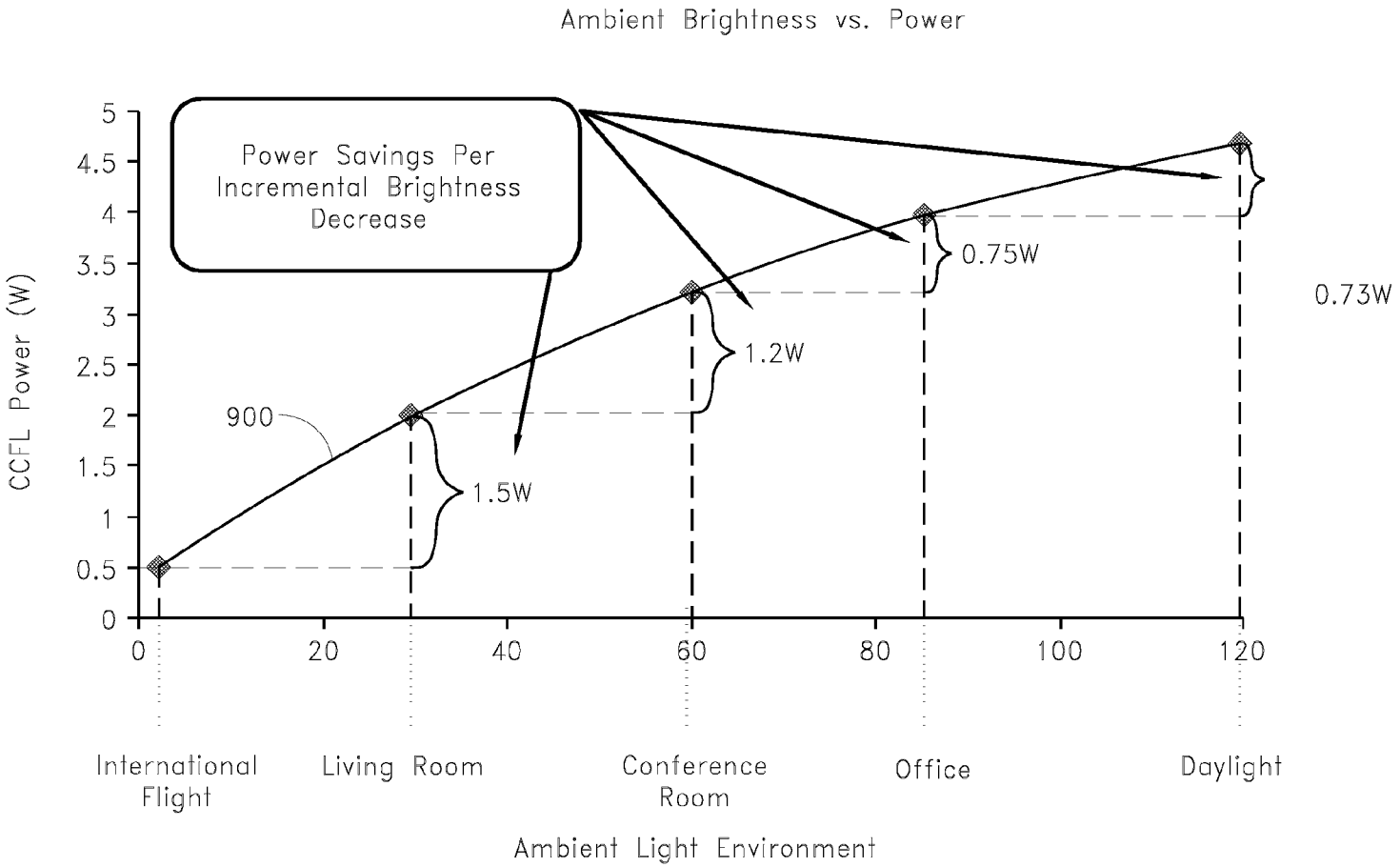
FIG. 9 illustrates power savings associated with decreasing brightness based on ambient light environment.

FIG. 9 illustrates power savings associated with decreasing brightness based on ambient light environment. A graph 900 shows increasing power consumption by a CCFL to produce substantially the same perceived intensity for a display panel as the ambient light increases from a dark environment (e.g., on an airplane) to a bright environment (e.g., daylight). Power can be saved by sensing the ambient (or environment) conditions and adjusting the lamp drive current accordingly. In one embodiment, the optical feedback loop described above can be modified to sense ambient light and make adjustments to lamp current for optimal efficiency. For example, operating lamp current can be decreased/increased when ambient light decreases/increases to save power while achieving substantially the same perceived brightness.

Figure 10A:
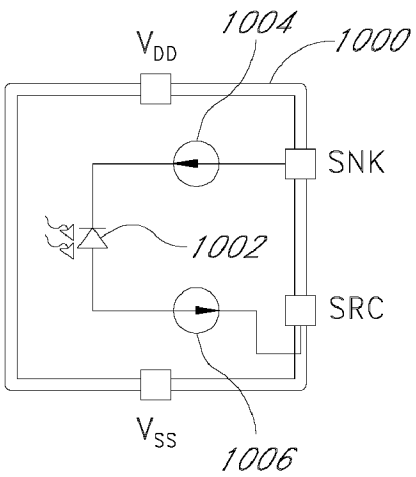
FIGS. 10A and 10B respectively illustrate a block diagram and wavelength sensitivity for one embodiment of a light sensor used to monitor visible light output of a lamp.
Figure 10B:
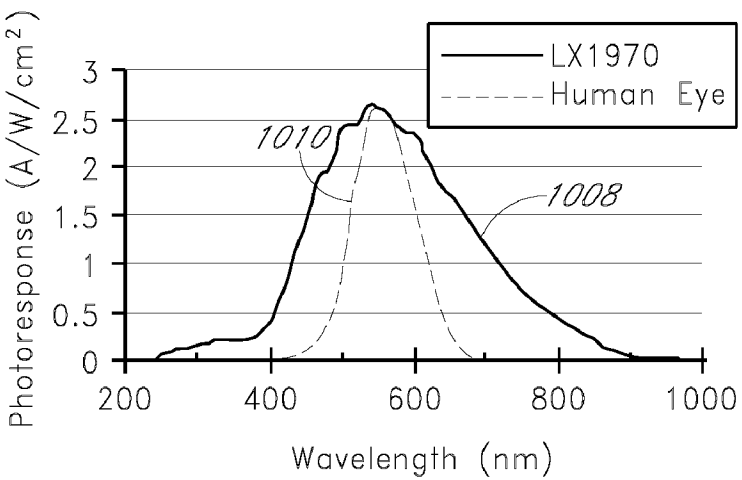

FIGS. 10A and 10B respectively illustrate a block diagram and wavelength sensitivity for one embodiment of a light sensor 1000 used to monitor visible light output of a CCFL or ambient light. CCFLs emit less visible light and more infrared light under relatively cold operating temperatures (e.g., during warm-up). The light sensor 1000 advantageously monitors mostly the visible portion of the light. In one embodiment, the light sensor (e.g., the LX1970 from Microsemi Corporation) 1000 includes a PIN diode array 1002 with an accurate, linear, and very repeatable current transfer function. The light sensor 1000 outputs a current sink 1004 and a current source 1006 with current levels that vary with sensed ambient light. The complementary current outputs of the light sensor 1000 can be easily scaled and converted to a voltage signal by connecting one or more resistors to either or both outputs. Referring to FIG. 10B, a graph 1008 shows the frequency response of the light sensor 1000 which approximates the frequency (or spectral) response of human eyes shown by graph 1010.

Figure 11:
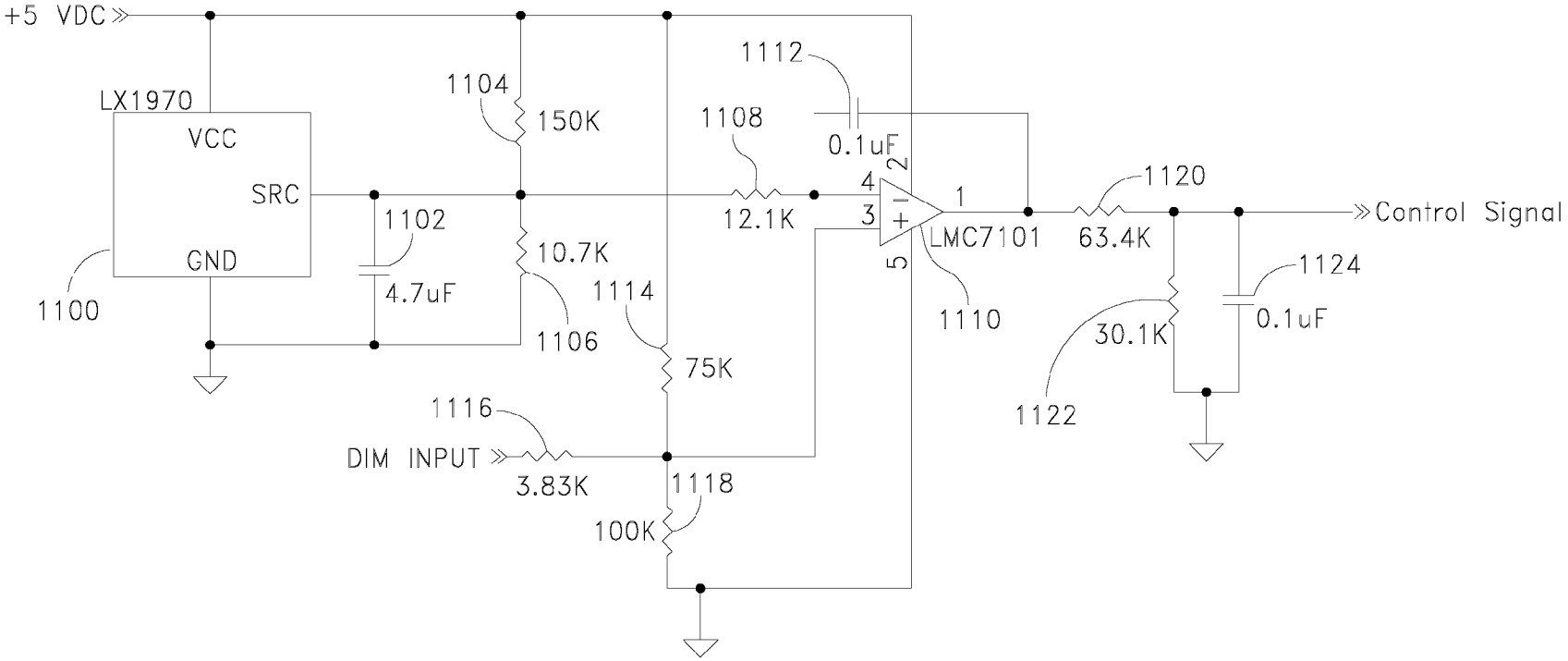
FIG. 11 is a schematic illustration of one embodiment of an automatic brightness control circuit that senses light output of a lamp and adjusts an inverter brightness control signal.

FIG. 11 is a schematic illustration of one embodiment of an automatic brightness control circuit that senses lamp light and generates a control signal for adjusting the operating current of the lamp. For example, the automatic brightness control circuit can vary the control signal until the sensed lamp light corresponds to a desired level indicated by a user input (e.g., DIM INPUT). Alternately, the automatic brightness control circuit can indicate when boost mode operation is desired to improve response speed of the lamp. The automatic brightness control circuit includes a visible light (or photo) sensor 1100 and an error gain amplifier 1110. In one embodiment, the visible light sensor 1100 and the error gain amplifier 1110 are both powered by a substantially DC supply voltage (e.g., +5 VDC). The visible light sensor 1100 monitors the lamp light and outputs a feedback current that is proportional to the level of the lamp light.

In one embodiment, the feedback current is provided to a preliminary low pass filter comprising a first capacitor 1102 coupled between the output of the visible light sensor 1100 and ground and a resistor divider 1104, 1106 coupled between the supply voltage and ground. The filtered (or converted) feedback current is provided to an inverting input of an integrating amplifier. For example, the output of the visible light sensor 1100 is coupled to an inverting input of the error gain amplifier 1110 via a series integrating resistor 1108. An integrating capacitor 1112 is coupled between the inverting input of the error gain amplifier 1110 and an output of the error gain amplifier 1110.

In one embodiment, a desired intensity (or dimming) level is indicated by presenting a reference level (DIM INPUT) at a non-inverting input of the integrating amplifier. The reference level can be variable or defined by a user. The reference level can be scaled by a series resistor 1116 coupled between the reference level and the non-inverting input of the error amplifier 1110 and a resistor divider 1114, 1118 coupled to the non-inverting input of the error amplifier 1110. The output of the error amplifier 1110 can be further filtered by a series resistor 1120 with a resistor 1122 and capacitor 1124 coupled in parallel at the output of the automatic brightness control circuit to generate the control signal for adjusting the operating lamp current.

Figure 12:
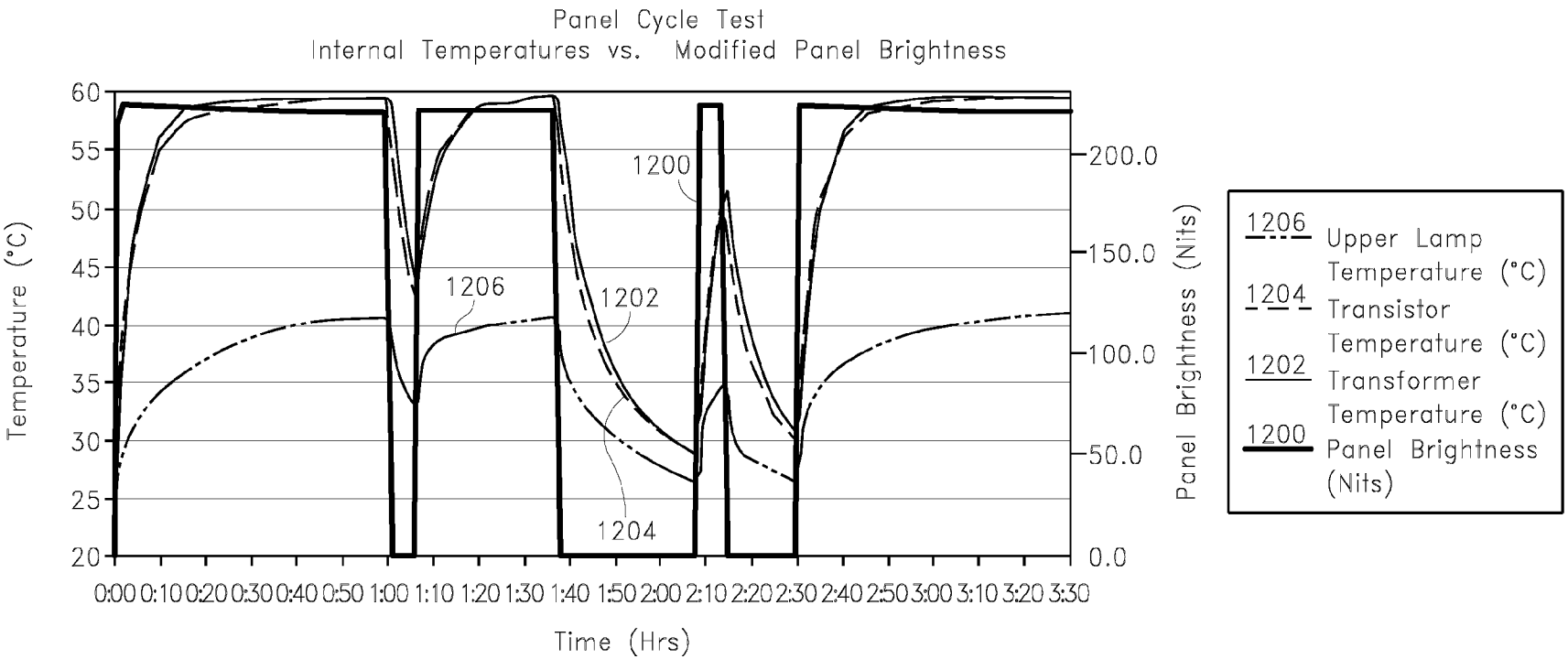
FIG. 12 illustrates waveforms for panel brightness and temperatures of select inverter components with respect to time using the automatic brightness control circuit as a display panel cycles on and off.

FIG. 12 is a graph illustrating panel brightness and temperatures of select inverter components with respect to time using the automatic brightness control circuit to monitor lamp intensity as a display panel cycles on and off. A graph 1200 shows the panel brightness modified by the automatic brightness control circuit. A graph 1202 shows the associated temperature profile for a transformer and a graph 1204 shows the associated temperature profile for a transistor in the inverter. Finally, a graph 1206 shows the upper lamp temperature profile. In comparison with similar graphs shown in FIG. 5, the corresponding graphs in FIG. 12 show faster transitions in reaching the desired panel brightness after turn on or exiting sleep mode by using the automatic brightness control circuit.

Figure 13:
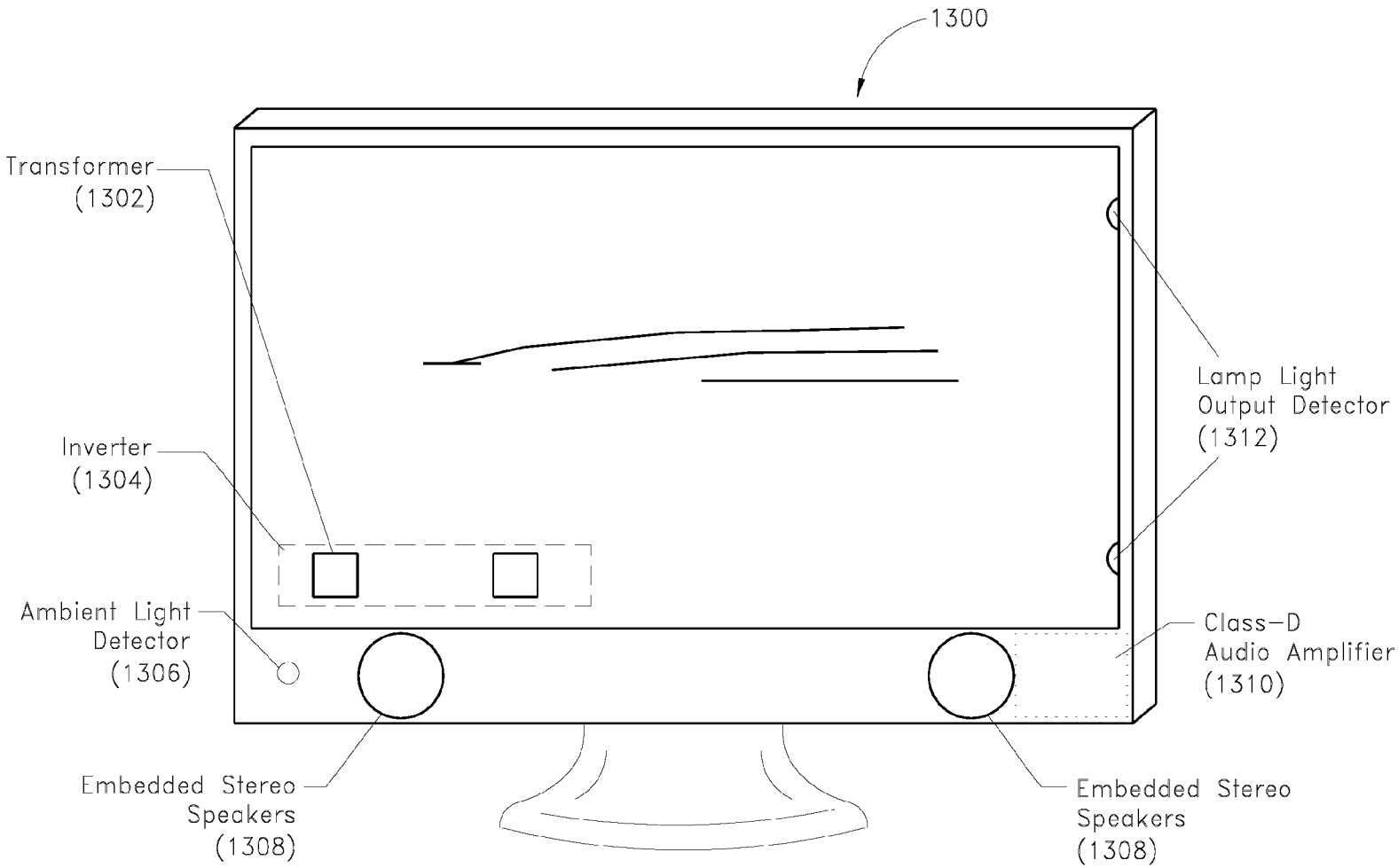
FIG. 13 illustrates one embodiment of a LCD monitor with a light detector which is interfaced to a lamp inverter for closed loop illumination control.

FIG. 13 illustrates one embodiment of a LCD monitor 1300 with light detectors 1306, 1312 which are interfaced to a lamp inverter 1304 for closed loop illumination control. One or more visible light detectors 1312 may be located proximate to one or more backlight lamps to monitor lamp intensity. The visible light detectors 1312 enhance warm-up and maintain constant backlight intensity over lamp life and operating temperature. An additional visible light detector 1306 may be located in a corner of the LCD monitor 1300 for monitoring ambient light. The additional visible light detector 1306 facilitates automatic adjustment of backlight intensity based on environment lighting. The lamp inverter 1304 with one or more low profile transformers 1302 can be located in a corner of the LCD monitor 1300. In one embodiment, the LCD monitor 1300 further includes embedded stereo speakers 1308 and a Class-D audio amplifier 1310.

Although described above in connection with CCFLs, it should be understood that a similar apparatus and method can be used to drive light emitting diodes, hot cathode fluorescent lamps, Zenon lamps, metal halide lamps, neon lamps, and the like While certain embodiments of the invention have been described, these embodiments have been presented by way of example only, and are not intended to limit the scope of the inventions. Indeed, novel methods and systems described herein may be embodied in a variety of other forms; furthermore, various omissions, substitutions and changes in the form of the methods and systems described herein may be made without departing from the spirit of the invention. The accompanying claims and their equivalents are intended to cover such forms or modifications as would fall within the scope and spirit of the inventions.

What is claimed is:

1. An illumination control circuit comprising:

a first optical sensor configured to detect visible light produced by a light source and to generate a first optical sensor output;

an error amplifier configured to generate a control signal based on a comparison of the first optical sensor output to a reference level;

a second optical sensor configured to detect ambient light and to generate a second optical sensor output; and an inverter controller configured to generate driving signals to control power to the light source, wherein the inverter controller operates in a boost mode to power the light source using a boosted AC current of a substantially constant level when the control signal from the error amplifier indicates that the first optical sensor output is less than the reference level, operates in a normal mode to power the light source using a nominal AC current that has a lower level than the boosted AC current when the control signal indicates that the first optical sensor output is greater than the reference level, and further adjusts power to the light source in response to a change in the second optical sensor output indicating a change in ambient light conditions.

2. The illumination control circuit of claim 1, wherein the light source provides backlight for a liquid crystal display and the second optical sensor is placed in front of the liquid crystal display.

3. The illumination control circuit of claim 1, wherein the error amplifier is an integrating amplifier and the control signal is a substantially DC control voltage that sets the level of a substantially AC current for the light source.

4. The illumination control circuit of claim 1, wherein the reference level corresponds to a desired brightness level of the light source and is variable by a user.

5. The illumination control circuit of claim 1, wherein the level of the boosted AC current is approximately 150% of the level of an initial nominal AC current.

6. The illumination control circuit of claim 1, wherein the first optical sensor comprises a first PIN diode array that outputs a first current source and a first current sink with respective current levels that vary with detected visible light from the light source while the second optical sensor comprises a second PIN diode array that outputs a second current source and a second current sink with respective current levels that vary with sensed ambient light.

7. The illumination control circuit of claim 6, further comprising a low pass filter or a gain amplifier coupled to one of the current sources or one of the current sinks to generate the first and the second optical sensor outputs.

8. The illumination control circuit of claim 1, wherein the light source is a light emitting diode, a cold cathode fluorescent lamp, a hot cathode fluorescent lamp, a Zenon lamp, or a metal halide lamp.

9. The illumination control circuit of claim 1, wherein the first optical sensor output is provided to an inverting input of the error amplifier and the reference level is provided to a non-inverting input of the error amplifier.

10. The illumination control circuit of claim 9, further comprising a low pass filter at an output of the error amplifier.

11. The illumination control circuit of claim 9, further comprising a pull-up resistor coupled between an output of the error amplifier and a pull-up control voltage corresponding to a predetermined maximum AC current for the light source.

12. A method to improve response speed of a light source, the method comprising the steps of:

sensing light produced by the light source with a first visible light sensor;

comparing an output of the first visible light sensor to a predetermined threshold level;

providing a substantially constant boost current to the light source when the output of the first visible light sensor is less than the predetermined threshold level;

providing a preset nominal current to the light source when the output of the first visible light sensor is approximately equal to or greater than the predetermined threshold level, wherein the preset nominal current has a lower average level than the boost current;

sensing ambient light with a second visible light sensor; and further adjusting power to the light source in response to changes in an output of the second visible light sensor.

13. The method of claim 12, wherein the substantially constant boost current is adjustable to vary the response speed of the light source.

14. The method of claim 12, wherein at least one of the first and the second visible light sensors is substantially immune to infrared light.

15. The method of claim 12, wherein the substantially constant boost current has a level that is at least 1.5 times higher than the level of the preset nominal current.

16. A liquid crystal display monitor comprising:

at least one visible light detector located proximate to one or more backlight lamps to monitor the intensity of the backlight lamps;

an inverter that monitors an output of the visible light detector and provides power to illuminate the backlight lamps, wherein the inverter operates in a boost mode to provide a boosted current to the backlight lamps when the output of the visible light detector is less than a threshold level and operates in a normal mode to provide a nominal current that has a lower level than the boosted current to the backlight lamps when the output of the visible light detector is greater than a threshold level; and an additional visible light detector located in a corner of the liquid crystal display monitor for monitoring ambient light, wherein said nominal current is adjusted responsive to said additional visible light detector.

17. The liquid crystal display monitor of claim 16, wherein each of the visible light detectors comprises a PIN diode array configured to generate complementary current outputs.

18. The liquid crystal display monitor of claim 16, wherein the inverter decreases brightness of the backlight lamps when an output of the additional visible light detector indicates a relatively dark environment and increases brightness of the backlight lamps when the output of the additional visible light detector indicates a relatively bright environment.

19. The liquid crystal display monitor of claim 16, further comprising embedded stereo speakers and a class-D audio amplifier.

20. The liquid crystal display monitor of claim 16, wherein the backlight lamps comprise a plurality of cold cathode fluorescent lamps.

* * * * *